US007802313B2

(12) United States Patent
Czajka

(10) Patent No.: US 7,802,313 B2
(45) Date of Patent: Sep. 28, 2010

(54) SURGICAL GOWNS AND OTHER PROTECTIVE APPAREL HAVING COLOR-CODING FOR IDENTIFYING BARRIER PROTECTION LEVELS AND METHODS OF MAKING SAME

(75) Inventor: Francis A. Czajka, Libertyville, IL (US)

(73) Assignee: Medline Industries, Inc., Mundelein, IL (US)

( * ) Notice: Subject to any disclaimer, the term of this patent is extended or adjusted under 35 U.S.C. 154(b) by 667 days.

(21) Appl. No.: 11/485,123

(22) Filed: Jul. 12, 2006

(65) Prior Publication Data

US 2007/0028344 A1 Feb. 8, 2007

Related U.S. Application Data

(60) Provisional application No. 60/698,569, filed on Jul. 12, 2005.

(51) Int. Cl.
*A41D 13/12* (2006.01)

(52) U.S. Cl. ..... 2/51; 2/457

(58) Field of Classification Search ..... 2/457, 2/901, 51, 114, 243.1, 115, 116, 85, 143, 2/456, 77, 79, 129, 48, 50, 69, 46, 244; 128/856, 128/855, 849; 40/586; 434/367; 206/570, 206/569, 223; D2/739, 602, 604
See application file for complete search history.

(56) References Cited

U.S. PATENT DOCUMENTS 4,019,207 A * 4/1977 Newman et al. ..... 2/51
4,290,148 A 9/1981 Roberts ..... 2/51
4,514,178 A * 4/1985 Noto et al. ..... 434/395
4,535,481 A * 8/1985 Ruth-Larson et al. ..... 2/114
4,550,246 A * 10/1985 Markman ..... 235/385
4,586,196 A 5/1986 White ..... 2/114
D305,830 S * 2/1990 Ciavatta ..... D2/602
4,947,867 A * 8/1990 Keeton ..... 128/846
4,971,073 A * 11/1990 Schneider ..... 128/874
5,271,100 A 12/1993 Holt ..... 2/114
5,444,873 A 8/1995 Levin ..... 2/114

(Continued)

OTHER PUBLICATIONS

Medline Industries, Inc., "Proxima OrthoMax Surgical Drapes," Marketing Brochure, © 2005, 2 pages.

(Continued)

*Primary Examiner*—Amy B Vanatta
(74) *Attorney, Agent, or Firm*—Nixon Peabody LLP

(57) ABSTRACT

A disposable surgical gown having a neck binding that includes a visual indicator to identify the barrier protection level associated with the disposable surgical gown. In particular, the disposable surgical gown has a neck binding that is color-coded for identifying the barrier protection level associated with the disposable surgical gown for protecting against penetration of body fluids and infectious materials. Also disclosed is a disposable surgical drape having a visual indicator, such as color-coding, to identify the barrier protection level associated with the disposable surgical drape. A surgical kit includes the disposable surgical gown and/or disposable surgical drape having visual indicators, such as color-coding, to identify the barrier protection level. The surgical kit may include other items to be used in a surgical setting which may also have visual indicators, such as color-coding, to identify the barrier protection level associated with the disposable surgical gown and/or disposable surgical drape.

22 Claims, 6 Drawing Sheets

U.S. PATENT DOCUMENTS

| | | | | |
|---|---|---|---|---|
| 5,561,861 | A | 10/1996 | Lopez et al. | 2/123 |
| 6,167,731 | B1 | 1/2001 | Lopez et al. | 66/172 R |
| 6,564,386 | B2 | 5/2003 | Fujikawa et al. | 2/51 |
| 6,687,918 | B1 * | 2/2004 | Hooks et al. | 2/275 |
| 6,851,125 | B2 | 2/2005 | Fujikawa et al. | 2/51 |
| 39,234 | A1 * | 1/2007 | Jordan et al. | 2/51 |
| 7,155,746 | B2 * | 1/2007 | Schorr et al. | 2/51 |
| 2002/0095709 | A1 | 7/2002 | Fujikawa et al. | 2/51 |
| 2002/0095711 | A1 | 7/2002 | Saito et al. | 2/71 |
| 2002/0164279 | A1 * | 11/2002 | Bourne et al. | 422/292 |
| 2004/0117889 | A1 * | 6/2004 | Shultz et al. | 2/69 |
| 2004/0163155 | A1 * | 8/2004 | Haughey | 2/69 |
| 2006/0070166 | A1 * | 4/2006 | Matt et al. | 2/113 |
| 2006/0218694 | A1 * | 10/2006 | Mathis et al. | 2/125 |
| 2007/0000006 | A1 * | 1/2007 | Jordan et al. | 2/51 |
| 2007/0000014 | A1 * | 1/2007 | Rotella et al. | 2/114 |
| 2007/0006885 | A1 * | 1/2007 | Shultz et al. | 128/856 |

OTHER PUBLICATIONS

Medline Industries, Inc., "Proxima Surgical Gowns New FDA Recognized Standard," Marketing Brochure, © 2004, 4 pages.

Cardinal Health, Inc., "Liquid Barrier Performance and Classification of Protective Apparel and Drapes Intended for Use of Health Care Facilities," Marketing Brochure, date unknown, © 2005, 8 pages.

Cardinal Health, Inc., "Convertors® Surgical Gown Selection Chart," date unknown, 5 pages.

Kimberly-Clark Worldwide, Inc., "Kimberly Clark Color-Key for Surgical Gowns for Instant Gown Recognition," Internet Printout, Feb. 21, 2006, 2 pages http://wvvw.kchealthcare.com/productpromosite/colorkey/www/Index.asp?action=ProductDetails &id=2098.

Kimberly-Clark Worldwide, Inc., "Kimberly Clark Color-Key for Surgical Gowns, Frequently Asked Questions," Internet Printout, Feb. 16, 2006. 3 pages http://www.kchealthcarer.com/productpromosite/colorkey/www/Index.asp?action=FAQs &id=2098.

Williamson, Julie E., "New gown, drape features have O.R. staff covered," *Healthcare Purchasing News* Online Jul. 2005, 10 pages http://www.hponline.com/inside/september%2005/0509or.html.

Cardinal Health, Inc., "Convertors® Infection Control Surgical Gowns," Internet Printout, Aug. 24, 2006, 2 pages, http://www.cardinal.com/mps/brands/convertors/surgicalgowns.asp.

Cardinal Health Inc., "Convertors® Infection Control Nonsterile Apparel," Internet Printout, Aug. 24, 2006, 3 pages, http://www.cardinal.com/mps/brands/convertors/nonsterile.asp.

Cardinal Health Inc., "Are your gown seams impervious to blood-borne pathogens?" Marketing Sheet for SmartGown® Surgical Gowns, date unknown, © 2004, 1 page.

Kimberly Clark, "A Guide to the Guidelines," *OR Today*, www.mdpublishing.com, Sep. 2004, 2 pages.

Belkin, Nathan L., "The new barrier standard—whose interests does it serve?" *AORN* Journal, Oct. 2004, 8 pages, http://www.findarticles.com/p/articles/mi__m0FSL/is__4__80/ai__n6353157/print.

Davis, Deborah, "Performance Standards: Measuring the Effectiveness of Protective Clothing," *Infection Control Today*, Jun. 2000, 7 pages, http://www.infectioncontroltoday.com/articles/061room.html.

Kimberly-Clark Worldwide, Inc., "Instant Gown Recognition with the Kimberly-Clark* Color-Key," Marketing Sheet, date unknown, © 2005, 1 page.

Foster, Christine, "Kimberly-Clark Health Care Introduces Visual Branding for Surgical Gowns," Marketing Announcement, date unknown, 2 pages.

Kimberly-Clark Worldwide, Inc., "Introducing the Kimberly-Clark* Color-Key for Instant Gown Recognition," Marketing Brochure, date unknown, © 2005, 6 pages.

Kimberly-Clark Corporation, "ULTRA Surgical Gown, Sterile, Large," Internet Printout, Feb. 16, 2006, © 2001, 1 page http://nacrm.kcmkt.com/scripts/wgate/zkcnab2c350e477d/~1N0YXR1PTM0DIwNjMx.

Cardinal Health Inc., "Surgical Gowns, Drapes and Packs," Convertors® Products Marketing Brochure, date unknown, 22 pages.

Blanchard, Joan, "Necrotizing fasciitis; cleaning hospital toys; disinfecting noncritical items; clinical practice patterns; barrier protection," AORN Journal, printed Jan. 9, 2006, © 2005, 6 pages http://www.findarticles.com/p/articles/mi__m)FSL/is__3__81/ai__n13471129/print.

Nelson Laboratories, "Nelson Laboratories Celebrates 20 Years of Service," vol. 3/2005, © 2005, 6 pages, http://www.nelsonlabs.com/docs/q3__nli__newsletter.pdf.

* cited by examiner

SURGICAL GOWNS AND OTHER PROTECTIVE APPAREL HAVING COLOR-CODING FOR IDENTIFYING BARRIER PROTECTION LEVELS AND METHODS OF MAKING SAME

CROSS-REFERENCE TO RELATED APPLICATION

This application claims the benefit of U.S. Provisional Application No. 60/698,569 filed Jul. 12, 2005, which is hereby incorporated by reference in its entirety.

FIELD OF THE INVENTION

The present invention relates to disposable surgical apparel, such as surgical gowns and surgical drapes, and more particularly to disposable surgical apparel having color-coded portions for identifying the barrier and/or fluid protection level of the disposable surgical apparel.

BACKGROUND OF THE INVENTION

Disposable surgical gowns are widely used by members of an operating team as a protective measure during the performance of surgery. The surgical gowns are made to cover the front and back torso and the arms of the surgical team member. The surgical gowns protect the members of the surgical team from coming into contact with bodily fluids during surgical procedures. To perform adequately, the surgical gown must prohibit the transfer of liquid, such as blood, plasma, serums and other liquids, thereby protecting the surgical team. Additionally, the surgical gowns are made sterile and are intended to prevent the possibility of infection being transmitted from the surgical team to the patient.

Disposable surgical drapes are also used during surgical procedures. Disposable surgical drapes provide protection to the patient by creating a sterile environment about the surgical site and maintaining an effective barrier that minimizes the passage of microorganisms between non-sterile and sterile areas. As with surgical gowns, the drape material should be resistant to blood and other bodily fluids to prohibit such fluids from contaminating the sterile field.

To adequately protect the surgical team, gown and drape manufacturers provide disposable surgical gowns and drapes that provide varying levels of protection against penetration of body fluids and infectious materials. By way of example, the Association for the Advancement of Medical Instrumentation ("AAMI") has established standards for barrier performance and has published guidelines for barrier classification of surgical gowns, surgical drapes and other protective surgical apparel. The ultimate goal of the established standards is to give doctors, nurses and staff the ability to make informed decisions regarding the protective barrier products that they wear. Gown and drape manufacturers now provide health care professionals with the ability to choose a protective barrier product that is designed for a particular procedure or protocol. For example, the current AAMI classification ranges from level 1 for the lowest barrier protection against penetration of bodily fluids to higher barrier protection levels including level 4 that currently provides the highest barrier protection against penetration of bodily fluids and infectious materials.

Gown and drape manufacturers currently provide surgical gowns and drapes having barrier protection commensurate with the AAMI protection levels. The surgical gowns and drapes are usually identified as having a specific AAMI barrier protection level on the outer packaging of the gown or drape. Thus, a surgical team member must read the information printed on the outer packaging to find the gown or drape with the desired protection level. Providing a way of identifying the barrier protection level without inspecting the wording on the packaging—which may be small and difficult to read—makes identification easier, less time-consuming, and generally less likely to be subject to errors of misidentifications.

Thus, it is desirable to provide disposable surgical gowns, disposable surgical drapes and other protective apparel that are more easily identified as having specific and/or desired barrier protection levels. It is also desirable to provide a surgical kit having a gown, drape, and/or other related items that are identified as having specific and/or desired barrier protection levels using a similar identification system for one or more components of the kit.

SUMMARY OF THE INVENTION

A disposable surgical gown is disclosed according to one embodiment of the present invention. The disposable surgical gown includes a main body having a front body portion and a back body portion. The front body portion and the back body portion have respective upper body portions. The disposable surgical gown also includes sleeves attached to the upper body portions of the front and back body portions and a neck binding attached to a periphery of the upper body portions of the front and back body portions. At least a portion of the neck binding has color-coding for identifying a barrier protection level provided by and/or associated with the disposable surgical gown. The disposable surgical gown protects against penetration of body fluids and infectious materials.

A method for making a disposable surgical gown is also disclosed. The method includes the step of fabricating a main body of the disposable surgical gown. The main body has a front body portion, a back body portion and sleeves attached to the respective upper body portions of the front and back body portions. The method also includes the step of attaching a neck binding to a periphery of the upper body portions of the front and back body portions. The neck binding is color-coded to identify a barrier protection level provided by and/or associated with the disposable surgical gown. The disposable surgical gown protects against penetration of body fluids and infectious materials. The method further includes the step of attaching at least one tie to the main body of the surgical gown.

A surgical kit is disclosed according to another embodiment of the present invention. The kit includes a disposable surgical gown. The disposable surgical gown protects against penetration of bodily fluids and infectious materials. The disposable surgical gown includes a main body including a front body portion, a back body portion and sleeves connected to the respective upper body portions of the front and back body portions. The disposable surgical gown also includes at least one tie that is attached to the main body and a neck binding attached to a periphery of the upper body portions of the front and back body portions. The neck binding is color-coded to identify a barrier protection level of the surgical gown. The kit also includes a pass card releasably attached to at least one tie of the disposable surgical gown. At least a portion of the pass card is color-coded to identify the barrier protection level of the disposable surgical gown. The kit further includes a package for holding the disposable surgical gown and the pass card.

A method of using a surgical kit is also disclosed. The method includes the steps of identifying a desired barrier protection level, providing the surgical kit comprising a disposable surgical gown meeting the desired barrier protection level, and donning the surgical gown with the desired barrier protection level. The disposable surgical gown has a neck binding that is color-coded to identify the barrier protection level provided by and/or associated with the surgical gown. The disposable surgical gown protects against penetration of body fluids and infectious materials.

In other embodiments of the present invention, a disposable surgical gown includes a main body having a front body portion and a back body portion. The front and back body portions have respective upper body portions. The disposable surgical gown also includes sleeves attached to the upper body portions of the front and back body portions and a neck binding attached to a periphery of the upper body portions of the front and back body portions. The neck binding has a visual indicator for identifying a barrier protection level provided by and/or associated with the disposable surgical gown. The disposable surgical gown protects against penetration of body fluids and infectious materials.

In yet another embodiment of the present invention, a surgical kit includes a disposable surgical gown. The disposable surgical gown protects against penetration of bodily fluids and infectious materials. The disposable surgical gown has a main body including a front body portion, a back body portion and sleeves connected to the respective upper body portions of the front and back body portions. The disposable surgical gown also includes at least one tie attached to the main body and a neck binding attached to a periphery of the upper body portions of the front and back body portions. The neck binding includes a visual indicator to identify a barrier protection level of the surgical gown. The surgical kit also includes a pass card releasably attached to at least one tie of the disposable surgical gown. At least a portion of the pass card is color-coded to identify the barrier protection level of the disposable surgical gown. The kit further includes a package for holding the disposable surgical gown and the pass card.

In yet another embodiment, a method of making a disposable surgical gown is disclosed. The method includes the steps of fabricating a main body of the disposable surgical gown. The main body has a front body portion, a back body portion and sleeves attached to respective upper body portions of the front and back body portions. The method also includes attaching a neck binding to a periphery of the upper body portions of the front and back body portions. The neck binding has a visual indicator to identify a barrier protection level provided by and/or associated with the disposable surgical gown. The disposable surgical gown protects against penetration of body fluids and infectious materials. The method further includes attaching at least one tie to the main body of the surgical gown.

In a further embodiment of the present invention, a method of using a surgical kit includes the steps of identifying a desired barrier protection level and providing a surgical kit having a disposable surgical gown that meets the desired barrier protection level. The disposable surgical gown has a neck binding that includes a visual indicator to identify the barrier protection level provided by and/or associated with the surgical gown. The disposable surgical gown protects against penetration of body fluids and infectious materials. The method further includes donning the surgical gown with the desired barrier protection level.

In a still further embodiment of the present invention, a disposable surgical gown is disclosed that comprises a main body including a front body portion and a back body portion and sleeves attached to the front and back body portions. The disposable surgical gown includes color-coding for identifying a barrier protection level associated with the disposable surgical gown. The disposable surgical gown may further comprise a neck binding attached to a periphery of the front and/or back body portions wherein at least a portion of the neck-binding includes color-coding for identifying the barrier protection level associated with the disposable surgical gown.

In another embodiment of the present invention, a disposable surgical gown is disclosed that comprises a main body including a front body portion and a back body portion, sleeves attached to the front and back body portions, and a neck binding attached to a periphery of at least the front body portion or the back body portion. The neck binding has a visual indicator for identifying a barrier protection level associated with the disposable surgical gown for protecting against penetration of body fluids and infectious materials.

In a further embodiment of the present invention, a surgical kit is disclosed that comprises a disposable surgical gown for protecting against penetration of bodily fluids and infectious materials, a pass card releasably attached to the disposable surgical gown, and a package for holding the disposable surgical gown and the pass card. The disposable surgical gown has a front body portion, a back body portion and sleeves connected to the front and back body portions. At least a portion of the disposable surgical gown includes color-coding to identify a barrier protection level of the disposable surgical gown. At least a portion of the pass card includes color-coding to identify the barrier protection level of the disposable surgical gown.

In a still further embodiment of the present invention, a surgical kit is disclosed that comprises a disposable surgical gown for protecting against penetration of bodily fluids and infectious materials, a pass card releasably attached to the disposable surgical gown, and a package for holding the disposable surgical gown and pass card. The disposable surgical gown has a front body portion, a back body portion and sleeves connected to the front and back body portions. The disposable surgical gown has a neck binding attached to a periphery of at least the front body portion or the back body portion. The neck binding has a visual indicator to identify a barrier protection level of the disposable surgical gown. At least a portion of the pass card has a visual indicator to identify the barrier protection level of the disposable surgical gown.

In yet another embodiment, a method of using a surgical kit is disclosed. The method includes the steps of identifying a desired barrier protection level, providing a surgical kit comprising a disposable surgical gown meeting the desired barrier protection level, and donning the disposable surgical gown with the desired barrier protection level. The disposable surgical gown is color-coded to identify the barrier protection level associated with the disposable surgical gown.

In a further embodiment, a method of using a surgical kit is disclosed. The method includes the steps of identifying a desired barrier protection level, providing a surgical kit comprising a disposable surgical gown meeting the desired barrier protection level, and donning the disposable surgical gown with the desired barrier protection level. The disposable surgical gown has a visual indicator to identify the barrier protection level associated with the disposable surgical gown for protecting against penetration of body fluids and infectious materials.

BRIEF DESCRIPTION OF THE DRAWINGS

The foregoing and other advantages of the invention will become apparent upon reading the following detailed description and upon reference to the drawings.

Figure 1:
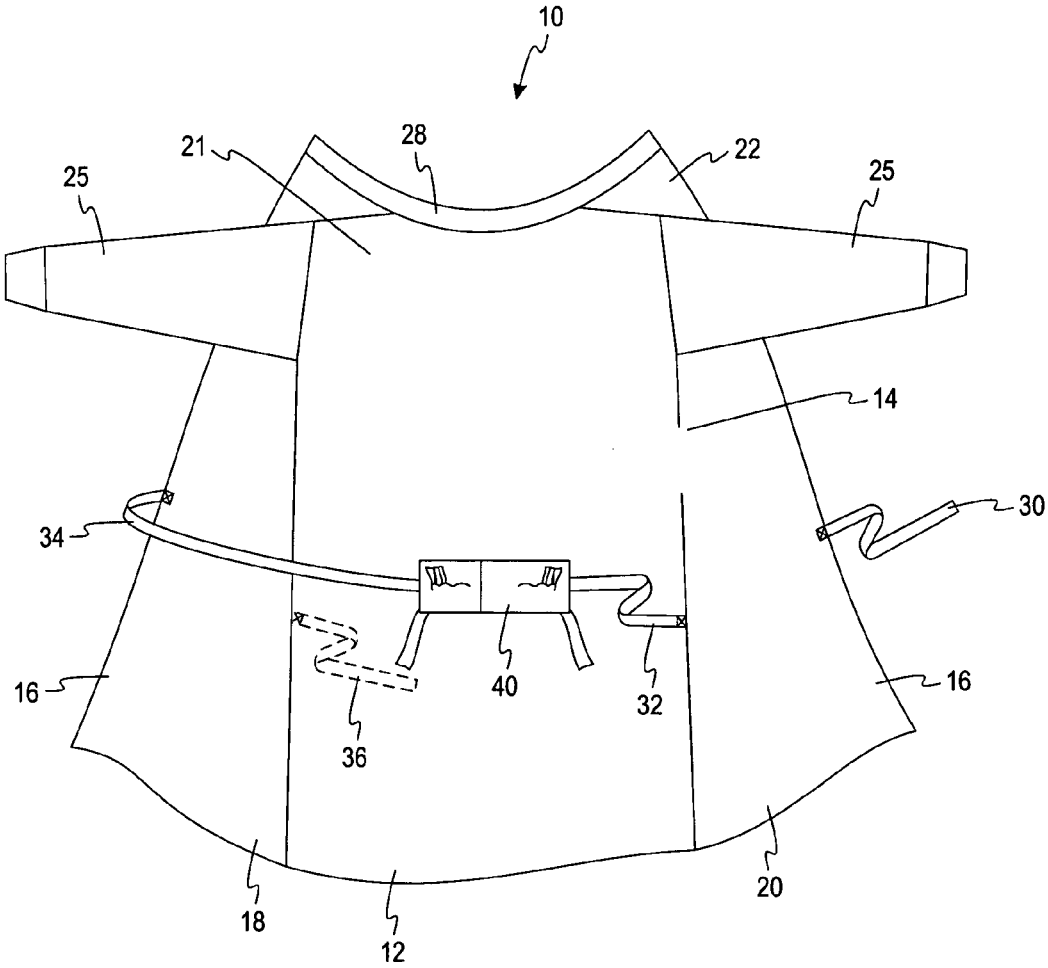
FIG. 1 is a perspective view of the front of a disposable surgical gown according to one embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention.

DESCRIPTION OF ILLUSTRATIVE EMBODIMENTS

FIG. 1 illustrates a disposable surgical gown 10 according to one embodiment of the present invention. The surgical gown 10 comprises a main body 12 having a front body portion 14 and a back body portion 16. The back body portion 16 includes a first side 18 and a second side 20. The front body portion 14 includes an upper body portion 21. The back body portion 16 also includes an upper body portion 22. A pair of sleeves 25 are attached to the upper body portions 21, 22 at the region where the front body portion 14 and back body portion 16 of the main body 12 meet. The surgical gowns described herein may also be reusable gowns.

The main body 12 and sleeves 25 of the disposable surgical gown 10 may be made of various woven or non-woven materials. These materials can include spunlace and spunbond and blends of polyester, polypropylene and/or polyethylene and combinations thereof. Suppliers of these fabrics include Cardinal Health in Dublin, Ohio, Kimberly-Clark in Neenah, Wis., Molnlycke Health Care in Newtown, Pa., and Precept Medical Products, Inc. in Arden, N.C. It is contemplated that other materials may be selected for use in the disposable surgical gowns described herein.

Figure 2:
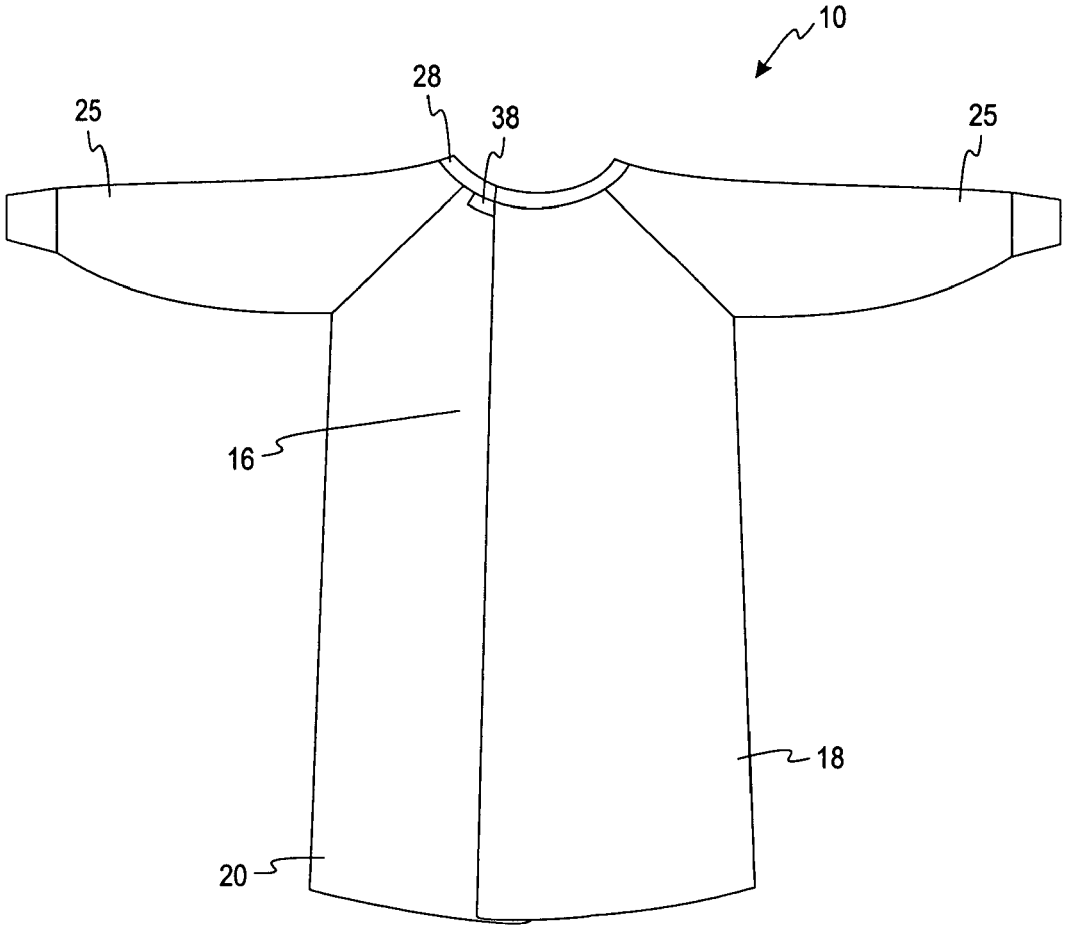
FIG. 2 is a perspective view of the back of the disposable surgical gown of FIG. 1.

Also attached to the surgical gown 10 is a neck binding 28. In FIGS. 1 and 2, the neck binding 28 is continuously attached along the periphery of the upper body portions 21, 22 of the surgical gown 10. As shown in FIGS. 1 and 2, the neck binding 28 is attached along the front body portion 14 and the first side 18 and the second side 20 of the back body portion 16 such that the neck binding 28 is visible by a person from front, side and back views. The neck binding 28 may be made of the same material as the surgical gown 10 or any suitable woven or non-woven material such as spunbond or spunlace, blends of polyester, polypropylene and/or polyethylene, and combinations thereof. In alternative embodiments, the neck binding may be attached along less than the entire periphery of the upper body portions 21, 22 (not shown). It is contemplated that other materials may be selected for use in the neck bindings described herein.

According to one embodiment of the present invention, the neck binding is color-coded for identifying a barrier protection level provided by and/or associated with the surgical gown 10. The barrier protection level designates the ability of the gown to protect against the penetration of body fluids and infectious materials. Barrier efficacy is recognized as important in helping to protect patients and health care personnel and to prevent the transmission of infectious materials. The Occupational Safety and Health Administration ("OSHA") has adopted regulations limiting occupational exposure to bloodborne pathogens (29 C.F.R. 1910.1030, July 2003). The Centers for Disease Control and Prevention has published "Guidelines for the Prevention of Surgical Site Infection" that also set forth the recommendations that drapes and gowns be impermeable to liquids and viruses.

One organization that has established a standard for barrier protection levels is the Association for the Advancement of Medical Instrumentation ("AAMI"). The current AAMI standard is described in "Liquid Barrier Performance and Classification of Protective Apparel and Drapes Intended for Use in Health Care Facilities," AAMI PB70:2003. This AAMI standard helps to preserve the sterile field and protect health care workers during surgery and other health care procedures during which exposure to blood, body fluids and other potential infectious material might occur. This AAMI standard establishes a system of classification and associated minimum requirements for protective apparel such as gowns and drapes used in health care facilities based on their liquid barrier performance.

The present AAMI standard for liquid barrier performance is provided in the following table:

TABLE 1

AAMI Barrier Protection Levels

| AAMI Level | Test | Result |
|---|---|---|
| 1 | AATCC 42:2000 | ≦4.5 grams |
| 2 | AATCC 42:2000 | ≦1.0 gram |
| | AATCC 127:1998 | ≧20 cm |
| 3 | AATCC 42:2000 | ≦1.0 gram |
| | AATCC 127:1998 | ≧50 cm |
| 4 | Gowns: ASTM F1671:2003 | Pass |
| | Drapes: ASTM F1670:2003 | Pass |

As shown in the table above, the AAMI uses two tests developed by the American Association of Textile Colorists and Chemists ("AATCC"). AATCC 42 measures a material's water resistance by impact penetration. The material to be tested is held at a 45-degree angle while a fixed amount of water is sprayed on it. A blotter affixed under the material is weighed before and after the water is sprayed to determine how much water penetrated the fabric. According to the present AAMI standard, the material is classified as Level 1 if the weight gain of the blotter is no more than 4.5 grams.

For present AAMI Level 2, the material to be tested must satisfy two AATCC tests—AATCC 42 and AATCC 127. The first test, AATCC 42, is the same as that used for Level 1 except that the increase in the blotter's weight must be no more than 1 gram. The additional test is AATCC 127 which measures a material's resistance to water penetration under hydrostatic pressure. Under this test, a sample of the material to be tested is clamped in place horizontally on the bottom of a glass, metered cylinder. Hydrostatic pressure is increased steadily by increasing the amount of water in the cylinder. To be acceptable for use as a present AAMI Level 2 barrier, the material must be able to resist the penetration of water when it reaches a level of 20 cm.

For present AAMI Level 3, both of the AATCC test methods described above must be satisfied, similar to the requirements to meet the present AAMI Level 2. For AATCC 42, the maximum blotter weight gain is the same as that for Level 2 (i.e., 1 gram). For AATCC 127 to be acceptable for use as a present AAMI Level 3 barrier, the level of water in the cylinder used in AATCC 127 must be at least 50 cm.

For present AAMI Level 4, the AAMI uses two tests developed by the American Society for Testing Materials ("ASTM")-F1670 for liquid penetration (i.e., surrogate blood) and F1671 for viral penetration (i.e., bacteriophage Phi-X174). For surgical gowns and other protective apparel, the material must meet the viral challenge of F1671 which measures the resistance of surgical gown materials to blood-borne pathogens using viral penetration at 2 psi and ambient pressure. For surgical drapes and accessories, the material must meet the liquid challenge of F1670 which measures the resistance of drape materials to penetration by synthetic blood at 2 psi and ambient pressure. For both tests, the results are expressed as pass or fail rather than in terms of a material's resistance.

For ASTM F1671, the material must pass the test for resistance to penetration by bacteriophage Phi-X174. A sample of the material to be tested is placed vertically in a test cell as a membrane between the media challenge (i.e., liquid) and a viewing chamber. Materials that permit penetration during an hour of a prescribed series of changes in air pressure are not considered suitable for use. For ASTM F1670, the material must pass the test for resistance to penetration by synthetic blood. As in the test for viral penetration, the material to be tested is mounted in a vertical position on a cell that separates the surrogate blood liquid challenge and the viewing chamber. The test is terminated if visible liquid penetration occurs at any time before or during 60 minutes of changes in pressure and atmospheric protocols.

Thus, to summarize, present AAMI Level 1 describes surgical gowns, other protective apparel, surgical drapes and drape accessories that demonstrate the ability to resist liquid penetration as determined by AATCC 42:2000 (water resistance: impact penetration test).

Present AAMI Level 2 describes surgical gowns, other protective apparel, surgical drapes and drape accessories that demonstrate the ability to resist liquid penetration as determined by AATCC 42:2000 (water resistance: impact penetration test) or AATCC 127:1998 (water resistance: hydrostatic pressure test).

Present AAMI Level 3 describes surgical gowns, other protective apparel, surgical drapes and drape accessories that demonstrate the ability to resist liquid penetration as determined by AATCC 42:2000 (water resistance: impact penetration test) and AATCC 127:1998 (water resistance: hydrostatic pressure test). For Level 3, the test criterion for AATCC 127:1998 performance is set at a higher value than that for Level 2.

Present AAMI Level 4 describes surgical gowns and protective apparel that demonstrate the ability to resist liquid and viral penetration as determined by ASTM F1671:2003 (standard test method for resistance materials used in protective clothing to penetration by blood-borne pathogens using Phi-X174 bacteriophage penetration as a test system). Level 4 also describes surgical drapes and drape accessories that demonstrate the ability to resist liquid penetration as determined by ASTM F1670:2003 (standard test method for resistance of materials used in protective clothing to penetration by synthetic blood).

The above description of AAMI's present standard for barrier protection is not meant to limit the invention to barrier protection levels that correspond only to AAMI standards. It is contemplated that other barrier protection level standards may be used with the present invention. Such other barrier protection level standards may include standards that have been developed or will be developed by the AAMI or other industry groups or industry practices.

As described above, the neck binding 28 is color-coded to indicate the specific level of barrier protection according to one embodiment of the present invention. For example, a disposable surgical gown having Level 1 barrier protection may have a neck binding that is a first color such as yellow. A disposable surgical gown having Level 2 barrier protection may have a neck binding that is a second color such as green. A disposable surgical gown having Level 3 barrier protection may have a neck binding that is a third color such as purple. A disposable surgical gown having Level 4 barrier protection may have a neck binding that is a fourth color such as dark blue.

It is contemplated that the present invention may be used with other color-coding schemes in addition to the color-coding scheme described above. Additionally, the color-coding scheme may vary based on, for example, changes in the AAMI standards or based on standards set by other organizations for the industry. The color-coding scheme may also be adapted to incorporate a particular customer's request regarding identification of barrier protection levels and/or to reflect changes in the industry as barrier protection levels are updated and/or redefined.

It is also contemplated that the neck binding may include other visual indicators corresponding to the barrier protection level. For example, the neck binding may include a pattern, a configuration, a design, text, characters, graphics, other indicia and/or combination(s) thereof in addition to, or in lieu of, the color-coding to indicate the barrier protection level. Furthermore, it is contemplated that the color-coding or use of other visual indicators may be included on other parts of the disposable gown other than or in addition to the neck binding to visually indicate the barrier protection level.

The disposable surgical gown 10 of the present invention may also include a tie, a strap, hook-and-loop type fasteners such as Velcro® or other closure means for securing together the first side 18 and the second side 20 of the back body portion 16. In some embodiments, the surgical gown 10 may include a number of outer and inner ties for securing the back body portion 16. For example, the disposable surgical gown 10 in FIG. 1 includes outer ties 30, 32, 34 and inner tie 36. The outer ties 30, 32, 34 and the inner tie 36 can be used for fastening the main body 12 of the disposable surgical gown 10 around the body of a user upon donning of the gown. Additionally, the outer ties 30, 32, 34 and the inner tie 36 may be used as a means of keeping the first side 18 and second side 20 closed. For example, the ties 30, 32, 34, 36 may be attached to the disposable surgical gown 10 such that, when in use, the first side 18 overlaps the second side 20 as shown in FIG. 2. In other embodiments, the ties 30, 32, 34, 36 may be attached to the disposable surgical gown 10 such that the first side 18 and the second side 20 do not overlap but provide adequate closure (not shown). The ties 30, 32, 34, 36 may be made of the same material as the gown or may be made of any other suitable woven or non-woven material such as spunbond or spunlace, blends of polyester, polypropylene and/or polyethylene, and combinations thereof. It is contemplated that the number and location of ties on the disposable surgical gown 10 may vary.

The back body portion 16 may include additional closure means such as hook-and-loop type fasteners such as Velcro®, ties, snaps, pins, buttons or other securing means. In particular, some surgical gowns 10 may have closure means at or near the neck binding 28, as indicated by reference numeral 38 in FIG. 2. In some embodiments, a hook-and-loop type fastener, such as Velcro®, is used to secure the first and second sides 18, 20.

As shown in FIG. 1, in one embodiment, the surgical gown 10 may include a pass card 40. The pass card 40 may have portions that are color-coded to correspond with the color-coded neck binding 28. Alternatively, the entire pass card 40 may be color-coded to correspond with the color-coded neck binding 28. The color-coded pass card 40 provides another way for a user to identify the barrier protection level provided by and/or associated with the surgical gown 10. In addition to or in lieu of color-coding, a visual indicator as described above may be used on the pass card 40. The pass card 40 may be releasably attached to at least one of the outer ties 30, 32, 34. The pass card 40 may be used to pass a tie, such as outer tie 34, from the sterile wearer of the disposable surgical gown 10 to a non-sterile person who, in turn, wraps the back portion 16 of the disposable surgical gown 10 around the wearer enclosing the back of the wearer. The wearer then grasps the remaining tie that is attached to the pass card 40, such as outer tie 32, without touching the contaminated pass card 40 and then ties outer ties 32, 34 together. The pass card 40 is typically made of paper, cardboard, or any other suitable material and includes slits or other openings for releasably attaching at least one of the outer ties 30, 32, 34. It is also contemplated that the pass card 40 may be attached to ties other than those mentioned above which may be attached to the disposable surgical gown 10 or other parts of the disposable surgical gown 10. Where a reusable surgical gown is used, pass card(s) may be provided separate from the surgical gown and releasably attached thereto.

According to one embodiment, the disposable surgical gown 10 may be made by fabricating the main body 12 of the surgical gown 10 to include a front body portion 14, a back body portion 16 and sleeves 25 attached to upper body portions 21, 22 of the front and back body portions 14, 16. The sleeves 25 may be attached to the upper body portions 21, 22 by stitching, ultrasonic sealing, or any other appropriate means of attachment. The neck binding 28 may be attached to a periphery of the upper body portions 21, 22. The neck binding 28 may be attached using glue, tape, stitching, ultrasonic sealing or any other appropriate means of attachment. Outer ties 30, 32, 34 and inner tie 36 may also be attached to the disposable surgical gown 10 by using glue, tape, stitching, ultrasonic sealing or any other appropriate means of attachment. As mentioned above, any number or combination of ties, in addition to the ties described herein, can be used with the disposable surgical gown 10 of the present invention.

Examples of disposable surgical gowns that may be used with embodiments of the present invention include Proxima® Surgical Gowns, Eclipse® Surgical Gowns, Sirus® Surgical Gowns, Aurora™ Surgical Gowns, and Prevention™ Surgical Gowns as manufactured by Medline Industries, Inc. in Mundelein, Ill. The embodiments of the present invention are not limited to the specific gowns recited above. Other disposable surgical gowns may be manufactured according to the present invention.

Figure 3:
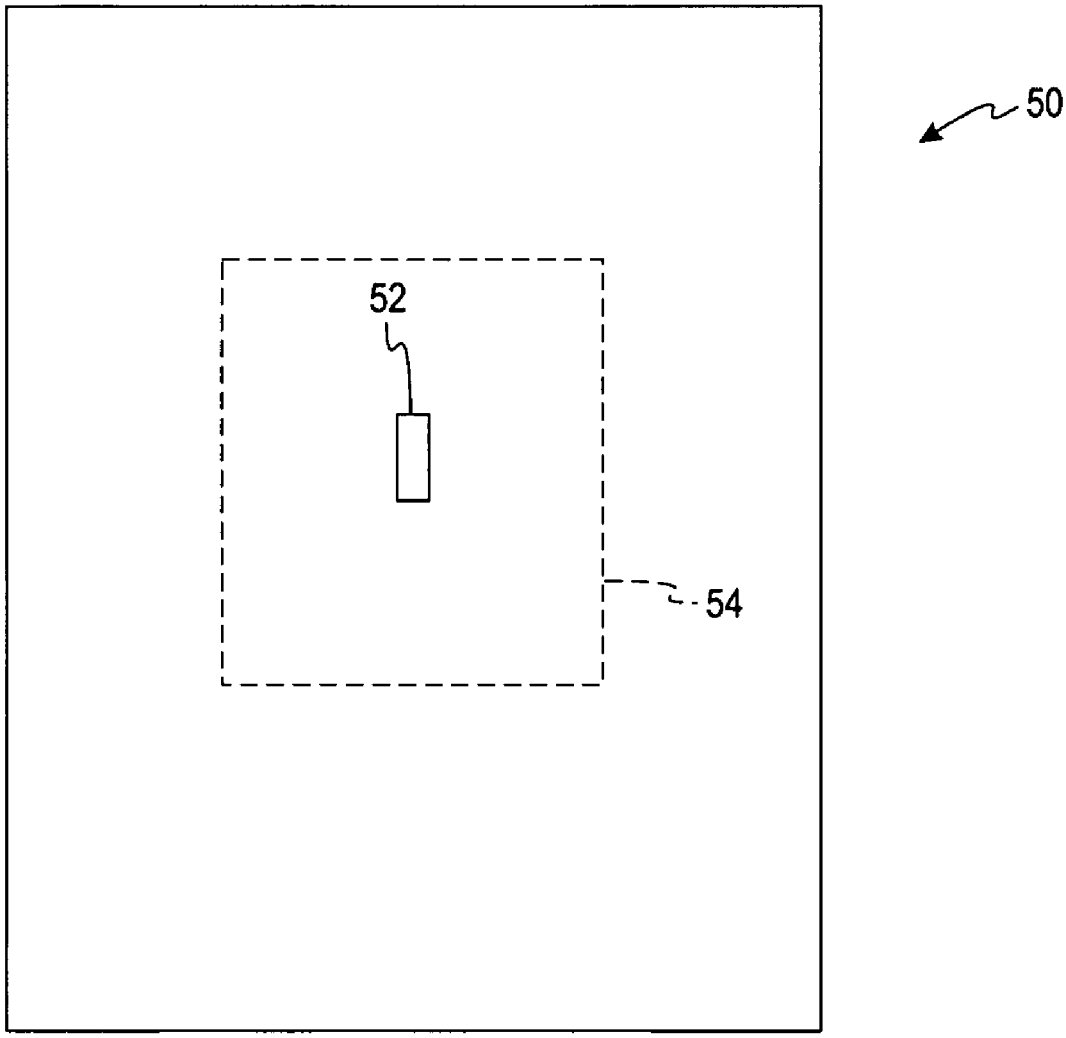
FIG. 3 is a perspective view of a disposable surgical drape according to another embodiment of the present invention.

Another embodiment of the present invention as shown in FIG. 3 is a disposable surgical drape 50. Most disposable surgical drapes of embodiments of the present invention are made of a water-repellent or water-impermeable material or are coated with such a material to prevent the passage of bodily fluids as well as contaminating microorganisms. The disposable surgical drapes of embodiments of the present invention may be made of the same material that is used for manufacturing the disposable surgical gowns described herein. The disposable surgical drape 50 may have color-coded portion(s) that correspond to barrier protection levels as adopted by the AAMI or other industry groups, or as requested by particular customers. For example, the disposable surgical drape 50 may be color-coded along the periphery of the edges of the drape or certain inner portions of the disposable surgical drape 50 may include color-coding or some type of visual indicator.

For example, a disposable surgical drape 50 having Level 1 barrier protection may have a portion of the disposable surgical drape 50 that is a first color such as yellow. A disposable surgical drape 50 having Level 2 barrier protection may have a portion of the disposable surgical drape 50 that is a second color such as green. A disposable surgical drape 50 having Level 3 barrier protection may have a portion of the disposable surgical drape 50 that is a third color such as purple. A disposable surgical drape 50 having Level 4 barrier protection may have a portion of the disposable surgical drape 50 that is a fourth color such as dark blue.

Disposable surgical drapes commonly have an opening or aperture 52 (more commonly known in the medical field as a "fenestration") through which the surgical procedure is performed. The surgical procedures performed often result in blood and other fluids being produced in the surgical site either directly from the patient or from irrigation fluids used to flush the site. One or more pouches (not shown) can be attached to the drape and/or be an integral part of the drape as it is made. Disposable surgical drapes often have a reinforced zone 54 that may be made of more durable, tear-resistant types of material, such as spunbond/meltblown/spunbond ("SMS"), spunlace, airlaid non-wovens, foam, rayon, any combination(s) thereof or any other suitable material. It is contemplated that other materials may be selected for use in the disposable surgical drapes described herein.

Examples of disposable surgical drapes that may be used with the embodiments of the present invention include Proxima® Drapes manufactured by Medline Industries, Inc. in Mundelein, Ill. The present invention is not limited to the specific drapes recited above or use in connection with the specific drapes recited above. Other disposable surgical drapes may be manufactured according to embodiments of the present invention.

Figure 4:
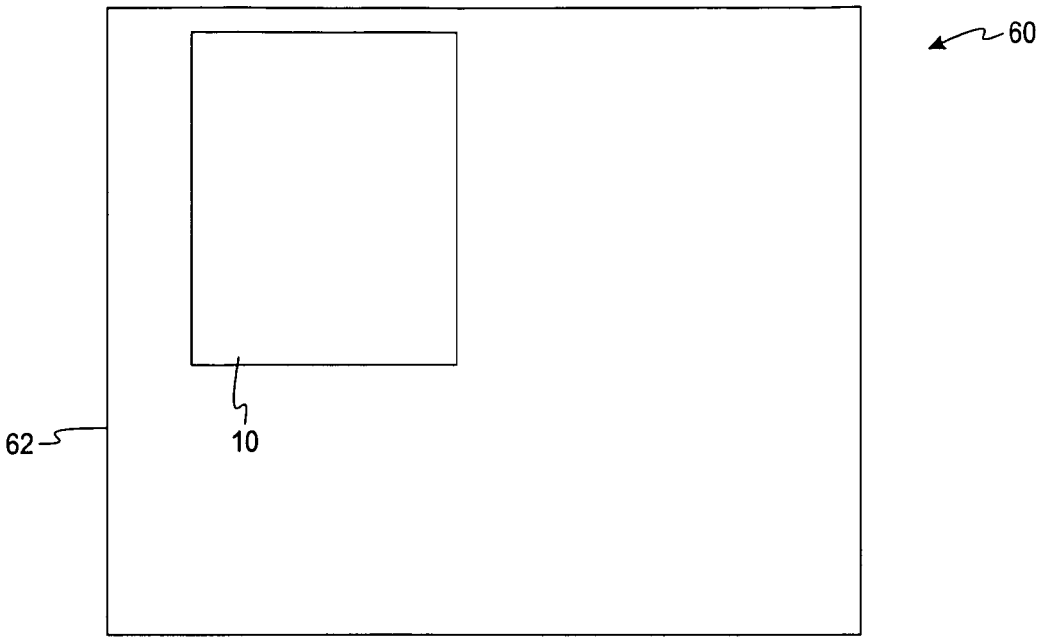
FIG. 4 is a front view of a surgical kit containing the disposable surgical gown of FIG. 1.

According to yet another embodiment of the present invention as shown in FIG. 4, a surgical kit 60 may be provided that includes the disposable surgical gown 10 of the embodiments of the present invention and a package 62 for holding the surgical gown 10. The disposable surgical gown 10 of the surgical kit 60 may have at least a color-coded neck binding 28 and a color-coded pass card 40 releasably attached to at least one tie 30, 32, 34 of the surgical gown 10. The disposable surgical gown 10 of the surgical kit 60 may have an attached pass card 40. It is contemplated that other variations of the surgical kit 60 may include the disposable surgical gown 10 wherein at least a portion of the neck binding 28 and pass card 40 are color-coded. Alternatively, the surgical kit 60 may include the disposable surgical gown 10 of the embodiments of the present invention having at least a neck binding 28 and/or pass card 40 that has a visual indicator to indicate the barrier protection level and a package 62 for holding the surgical gown 10 with attached pass card 40. As described above, the pass card 40 may be attached to at least one tie 30, 32, 34 or any other tie that may be attached to the disposable surgical gown 10.

It is also contemplated that in addition to or in lieu of the disposable surgical gown 10, the surgical kit 60 as described above may include the disposable surgical drape 50 wherein at least a portion of the drape 50 is color-coded or includes a visual indicator to indicate the barrier protection level of the disposable surgical drape 50.

Figure 5:
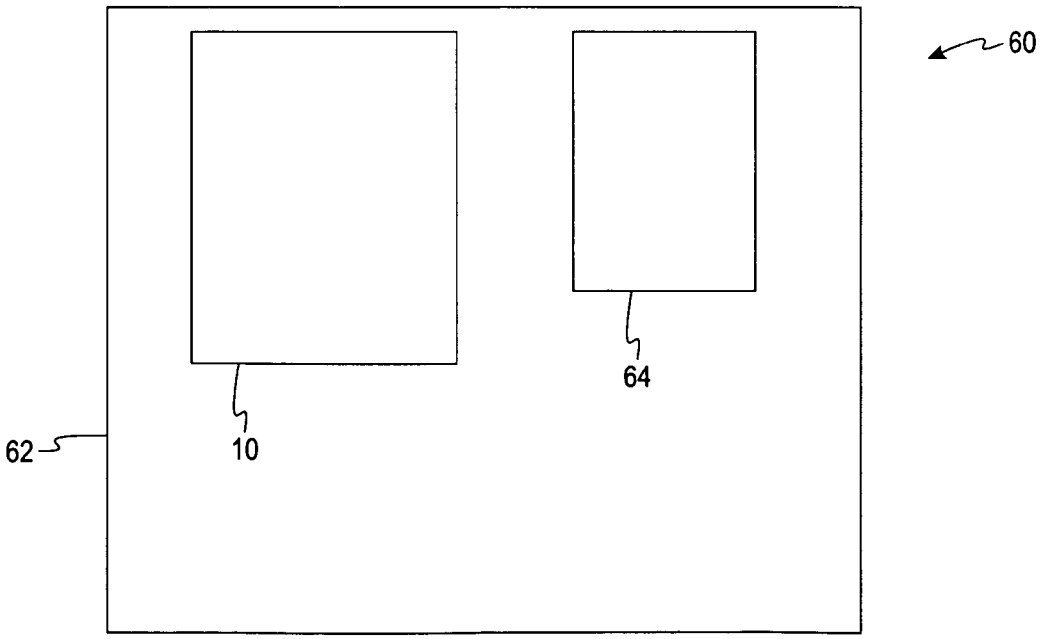
FIG. 5 is a front view of a surgical kit containing the disposable surgical gown of FIG. 1 and an insert.
Figure 6:
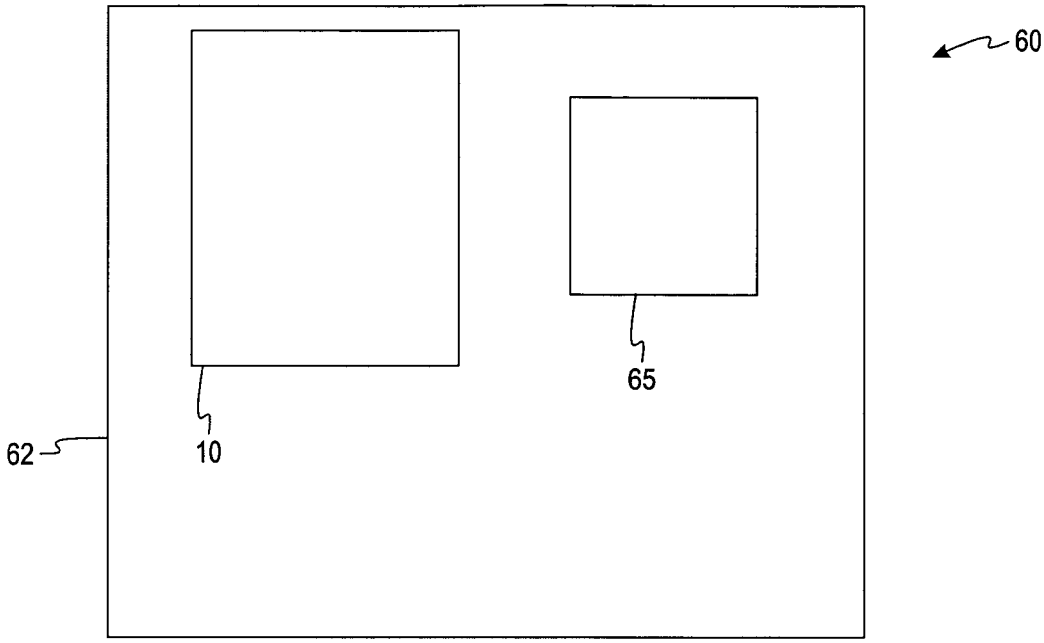
FIG. 6 is a front view of a surgical kit containing the disposable surgical gown of FIG. 1 and a surgical wrap.
Figure 7:
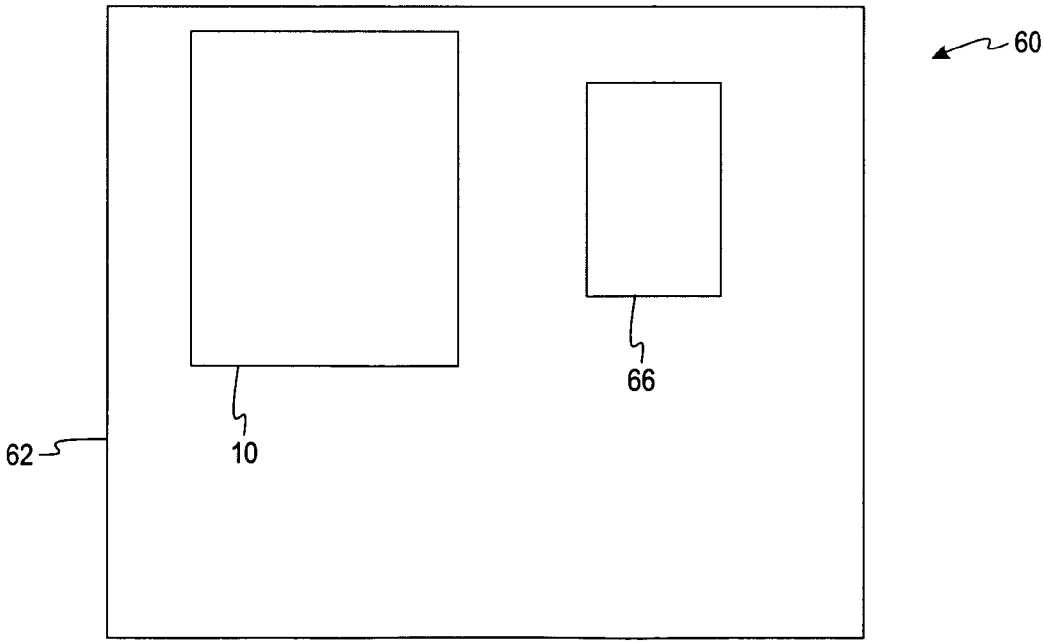
FIG. 7 is a front view of a surgical kit containing the disposable surgical gown of FIG. 1 and a hand towel.

In other embodiments, the surgical kit 60 may additionally or alternatively include an insert 64 which describes the contents of the surgical kit (FIG. 5). At least a portion of the insert 64 may be color-coded or have a visual indicator corresponding to the barrier protection level of the disposable surgical gown 10 and/or disposable surgical drape 50. The surgical kit 60 may additionally or alternatively include a surgical wrap 65 (FIG. 6) to protect the sterility of the disposable surgical gown 10 and/or disposable surgical drape 50. The surgical kit 60 may additionally or alternatively include a hand towel 66 (FIG. 7) for use by a member of a surgical team for wiping one's hands before donning the surgical gown 10. The surgical wrap 65 and hand towel 66 may also have at least a portion of the surgical wrap 65 and hand towel 66 that are color-coded or have a visual indicator corresponding to the barrier protection level of the disposable surgical gown 10 and/or disposable surgical drape 50.

Figure 8:
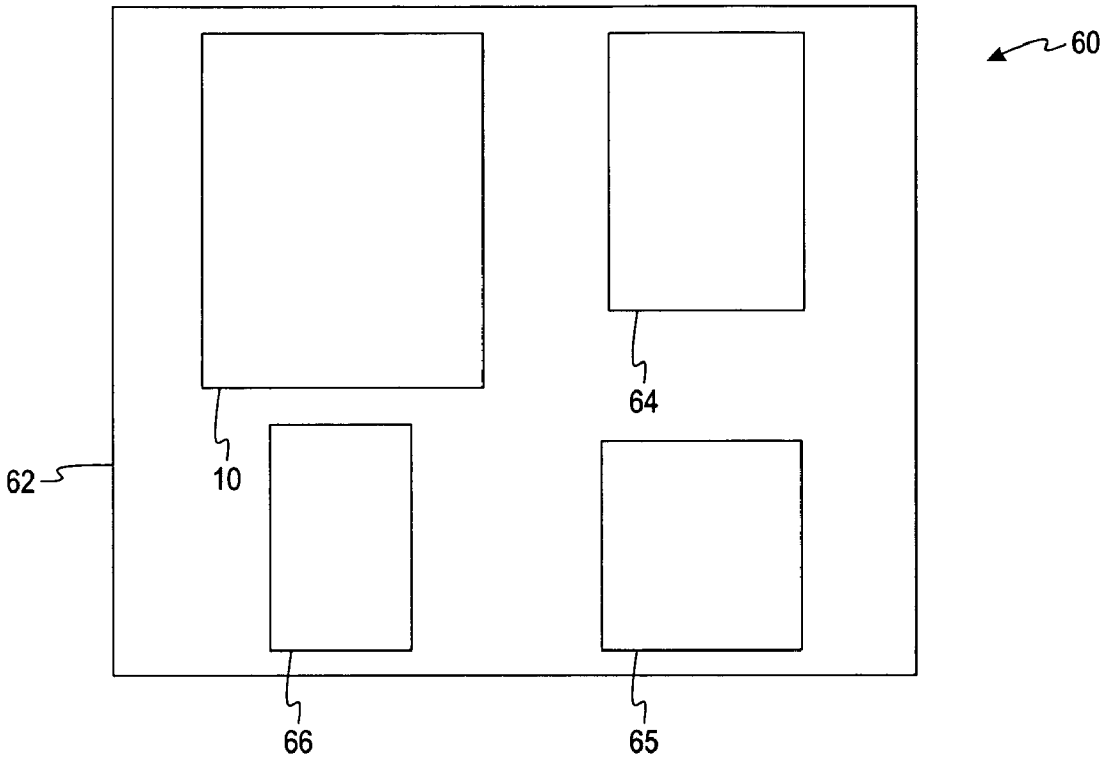
FIG. 8 is a front view of a surgical kit containing the disposable surgical gown of FIG. 1, an insert, a surgical wrap and a hand towel.

In some embodiments, the surgical kit 60 may contain multiple items, such as, but not limited to, an insert 64, a surgical wrap 65 and a hand towel 66 as shown in FIG. 8. The surgical kit 60 is not meant to be limited to the items mentioned above and may contain one or more of the items described herein as well as other items that may not typically be used in surgical settings such as table covers and other disposable surgical products.

Further embodiments may include a method of using the surgical kit 60 described above. This method may include identifying a desired barrier protection level according to established guidelines such as those defined by the AAMI's liquid barrier performance classifications, providing the surgical kit 60 having a disposable surgical gown 10 meeting the desired barrier protection level, and donning the disposable surgical gown 10 with the desired barrier protection level for use during a surgical procedure. Yet other embodiments may include a method of using the surgical kit 60 including the steps of identifying a desired barrier protection level according to established guidelines such as defined by the AAMI's liquid barrier performance classifications, providing the surgical kit 60 having a disposable surgical drape 50 meeting the desired barrier protection level, and using the disposable surgical drape 50 with the desired barrier protection level during a surgical procedure.

According to alternative embodiment A, a disposable surgical gown comprising a main body including a front body portion and a back body portion, the front body portion and the back body portion having respective upper body portions; sleeves attached to the upper body portions of the front and back body portions; a neck binding attached to a periphery of the upper body portions of the front and back body portions, at least a portion of the neck binding having color-coding for identifying a barrier protection level associated with the disposable surgical gown for protecting against penetration of body fluids and infectious materials.

According to alternative embodiment B, the disposable surgical gown of alternative embodiment A wherein the color-coding relates to barrier protection levels designated by the Association for the Advancement of Medical Instrumentation standard, AAMI PB70:2003.

According to alternative embodiment C, the disposable surgical gown of alternative embodiment B wherein the color-coding identifies barrier protection level 1 of AAMI PB70:2003.

According to alternative embodiment D, the disposable surgical gown of alternative embodiment C wherein the color-coding is yellow.

According to alternative embodiment E, the disposable surgical gown of alternative embodiment C wherein the disposable gown protects against penetration of body fluids as determined by AATCC 42:2000.

According to alternative embodiment F, the disposable surgical gown of alternative embodiment B wherein the color-coding identifies barrier protection level 2 of AAMI PB70:2003.

According to alternative embodiment G, the disposable surgical gown of alternative embodiment F wherein the color-coding is green.

According to alternative embodiment H, the disposable surgical gown of alternative embodiment F wherein the disposable gown protects against penetration of body fluids as determined by AATCC 42:2000 and AATCC 127:1998.

According to alternative embodiment I, the disposable surgical gown of alternative embodiment B wherein the color-coding identifies barrier protection level 3 of AAMI PB70:2003.

According to alternative embodiment J, the disposable surgical gown of alternative embodiment I wherein the color-coding is purple.

According to alternative embodiment K, the disposable surgical gown of alternative embodiment I wherein the disposable gown protects against penetration of body fluids as determined by AATCC 42:2000 and AATCC 127:1998.

According to alternative embodiment L, the disposable surgical gown of alternative embodiment B wherein the color-coding identifies barrier protection level 4 of AAMI PB70:2003.

According to alternative embodiment M, the disposable surgical gown of alternative embodiment L wherein the color-coding is dark blue.

According to alternative embodiment N, the disposable surgical gown of alternative embodiment L wherein the disposable gown protects against penetration of body fluids and infectious materials as determined by ASTM F1671:2003 and ASTM F1670:2003.

According to alternative embodiment O, the disposable surgical gown of alternative embodiment A further comprising at least one tie for securing the main body of the disposable surgical gown.

According to alternative embodiment P, the disposable surgical gown of alternative embodiment O further comprising a color-coded pass card that is releasably attached to the at least one tie, at least a portion of the color-coded pass card having the same color-coding as the color-coding of the neck binding for identifying the barrier protection level of the disposable surgical gown.

According to alternative embodiment Q, the disposable surgical gown of alternative embodiment A further comprising inner and outer ties for fastening the main body of the disposable surgical gown around the body of a user.

According to alternative embodiment R, the disposable surgical gown of alternative embodiment Q further comprising a color-coded pass card that is releasably attached to at least one of the inner and outer ties, at least a portion of the color-coded pass card having the same color-coding as the color-coding of the neck binding for identifying the barrier protection level of the disposable surgical gown.

According to alternative embodiment S, the disposable surgical gown of alternative embodiment A further including closure means such as hook-and-loop fasteners, ties, snaps, and pins.

According to alternative embodiment T, a surgical kit comprising a disposable surgical gown for protecting against penetration of bodily fluids and infectious materials, the disposable surgical gown having a main body including a front body portion, a back body portion and sleeves connected to upper body portions of the front and back body portions, a neck binding attached to a periphery of the upper body portions of the front and back body portions that is color-coded to identify a barrier protection level of the surgical gown, and at least one tie attached to the main body; a pass card releasably attached to the at least one tie, at least a portion of the pass card being color-coded to identify the barrier protection level of the disposable surgical gown; and a package for holding the disposable surgical gown and the pass card.

According to alternative embodiment U, the surgical kit of alternative embodiment T wherein the color-coding identifies the barrier protection levels designated by the Association for the Advancement of Medical Instrumentation standard, AAMI PB70:2003.

According to alternative embodiment V, the surgical kit of alternative embodiment T further comprising an insert which describes the contents of the surgical kit, at least a portion of the insert being color-coded to identify the barrier protection level of the surgical gown.

According to alternative embodiment W, the surgical kit of alternative embodiment T further comprising a surgical wrap for protecting the sterility of the surgical gown.

According to alternative embodiment X, the surgical kit of alternative embodiment W wherein the surgical wrap is color-coded to identify the barrier protection level of the disposable surgical gown.

According to alternative embodiment Y, the surgical kit of alternative embodiment T further comprising a hand towel for wiping the hands of a user before donning the surgical gown.

According to alternative embodiment Z, the surgical kit of alternative embodiment Y wherein the hand towel is color-coded to identify the barrier protection level of the disposable surgical gown.

According to alternative embodiment AA, a method of making a disposable surgical gown, comprising the steps of fabricating a main body of the disposable surgical gown, the main body having a front body portion, a back body portion and sleeves attached to upper body portions of the front and back body portions; attaching a neck binding to a periphery of the upper body portions of the front and back body portions, the neck binding being color-coded to identify a barrier protection level associated with the disposable surgical gown for protecting against penetration of body fluids and infectious materials; and attaching at least one tie to the main body of the surgical gown.

According to alternative embodiment BB, the method of alternative embodiment AA wherein the color-coding identifies barrier protection levels designated by the Association for the Advancement of Medical Instrumentation standard, AAMI PB70:2003.

According to alternative embodiment CC, the method of alternative embodiment BB further comprising connecting a pass card to the at least one tie, at least a portion of the pass card being color-coded to identify the barrier protection level of the disposable surgical gown.

According to alternative embodiment DD, a method of using a surgical kit comprising the steps of identifying a desired barrier protection level; providing the surgical kit comprising a disposable surgical gown meeting the desired barrier protection level, the disposable surgical gown having a neck binding that is color-coded to identify the barrier protection level associated with the surgical gown for protecting against penetration of body fluids and infectious materials; donning the surgical gown with the desired barrier protection level.

According to alternative embodiment EE, the method of alternative embodiment DD wherein the barrier protection level is designated by the Association for the Advancement of Medical Instrumentation standard, AAMI PB70:2003.

According to alternative embodiment FF, a disposable surgical gown comprising a main body including a front body portion and a back body portion, the front and back body portions having respective upper body portions; sleeves attached to the upper body portions of the front and back body portions; and a neck binding attached to a periphery of the upper body portions of the front and back body portions, the neck binding having a visual indicator for identifying a barrier protection level associated with the disposable surgical gown for protecting against penetration of body fluids and infectious materials.

According to alternative embodiment GG, a surgical kit comprising a disposable surgical gown for protecting against penetration of bodily fluids and infectious materials, the disposable surgical gown having a main body including a front body portion, a back body portion and sleeves connected to upper body portions of the front and back body portions, a neck binding attached to a periphery of the upper body portions of the front and back body portions having a visual indicator to identify a barrier protection level of the surgical gown, and at least one tie attached to the main body; a pass card releasably attached to the at least one tie, at least a portion of the pass card being color-coded to identify the barrier protection level of the disposable surgical gown; and a package for holding the disposable surgical gown and pass card.

According to alternative embodiment HH, a method of making a disposable surgical gown, comprising the steps of fabricating a main body of the disposable surgical gown, the main body having a front body portion, a back body portion and sleeves attached to upper body portions of the front and back body portions; attaching a neck binding to a periphery of the upper body portions of the front and back body portions, the neck binding having a visual indicator to identify a barrier protection level associated with the disposable surgical gown for protecting against penetration of body fluids and infectious materials; and attaching at least one tie to the main body of the surgical gown.

According to alternative embodiment II, a method of using a surgical kit comprising the steps of identifying a desired barrier protection level; providing the surgical kit comprising a disposable surgical gown meeting the desired barrier protection level, the disposable surgical gown having a neck binding having a visual indicator to identify the barrier protection level associated with the surgical gown for protecting against penetration of body fluids and infectious materials; and donning the surgical gown with the desired barrier protection level.

According to alternative embodiment III, a method of using a surgical kit comprises the steps of identifying a desired barrier protection level and providing the surgical kit comprising a disposable surgical gown meeting the desired barrier protection level. The disposable surgical gown has a neck binding having a visual indicator to identify the barrier protection level provided by and/or associated with the surgical gown for protecting against penetration of body fluids and infectious materials. The method further including donning the surgical gown with the desired barrier protection level.

According to alternative embodiment JJ, a disposable surgical gown comprises a main body including a front body portion and a back body portion, the front body portion and the back body portion having respective upper body portions. The disposable surgical gown also comprising sleeves attached to the upper body portions of the front and back body portions and a neck binding attached to a periphery of the upper body portions of the front and back body portions. At least a portion of the neck binding has color-coding for identifying a barrier protection level provided by and/or associated with the disposable surgical gown for protecting against penetration of body fluids and infectious materials.

According to the alternative embodiment KK, the disposable surgical gown of alternative embodiment JJ, further including closure means comprising hook-and-loop fasteners, ties, snaps, and pins.

According to alternative embodiment LL, a surgical kit comprises a disposable surgical gown for protecting against penetration of bodily fluids and infectious materials. The disposable surgical gown has a main body including a front body portion, a back body portion and sleeves connected to respective upper body portions of the front and back body portions. The disposable surgical gown including a neck binding attached to a periphery of the upper body portions of the front and back body portions that is color-coded to identify a barrier protection level of the surgical gown. The disposable surgical gown also including at least one tie attached to the main body, a pass card releasably attached to the at least one tie, at least a portion of the pass card being color-coded to identify the barrier protection level of the disposable surgical gown, and a package for holding the disposable surgical gown and the pass card.

According to alternative embodiment MM, the surgical kit of alternative embodiment LL, further comprising an insert which describes the contents of the surgical kit, at least a portion of the insert being color-coded to identify the barrier protection level of the disposable surgical gown.

According to alternative embodiment NN, the surgical kit of alternative embodiment LL further comprising a surgical wrap.

According to alternative embodiment OO, the surgical kit of alternative embodiment LL further comprising a hand towel.

According to alternative embodiment PP, a method of making a disposable surgical gown comprises the steps of fabricating a main body of the disposable surgical gown, the main body having a front body portion, a back body portion and sleeves attached to respective upper body portions of the front and back body portions. The method further including attaching a neck binding to a periphery of the upper body portions of the front and back body portions, the neck binding being color-coded to identify a barrier protection level provided by and/or associated with the disposable surgical gown for protecting against penetration of body fluids and infectious materials. The method further including attaching at least one tie to the main body of the surgical gown.

According to alternative embodiment QQ, a method of using a surgical kit comprises the steps of identifying a desired barrier protection level and providing the surgical kit comprising a disposable surgical gown meeting the desired barrier protection level. The disposable surgical gown has a neck binding that is color-coded to identify the barrier protection level provided by and/or associated with the surgical gown for protecting against penetration of body fluids and infectious materials. The method further comprising donning the surgical gown with the desired barrier protection level.

According to alternative embodiment RR, a disposable surgical gown comprises a main body including a front body portion and a back body portion, the front and back body portions having respective upper body portions and sleeves attached to the upper body portions of the front and back body portions. The disposable surgical gown also comprising a neck binding attached to a periphery of the upper body portions of the front and back body portions, at least a portion of the neck binding having a visual indicator for identifying a barrier protection level provided by and/or associated with the disposable surgical gown for protecting against penetration of body fluids and infectious materials.

According to alternative embodiment SS, a surgical kit comprising a disposable surgical gown for protecting against penetration of bodily fluids and infectious materials. The disposable surgical gown has a main body including a front body portion, a back body portion and sleeves connected to respective upper body portions of the front and back body portions and a neck binding attached to a periphery of the upper body portions of the front and back body portions having a visual indicator to identify a barrier protection level of the surgical gown, and at least one tie attached to the main body. The surgical kit also comprising a pass card releasably attached to the at least one tie, at least a portion of the pass card having a visual indicator to identify the barrier protection level of the disposable surgical gown, and a package for holding the disposable surgical gown and the pass card.

According to alternative embodiment TT, a method of making a disposable surgical gown comprises the steps of fabricating a main body of the disposable surgical gown, the main body having a front body portion, a back body portion and sleeves attached to respective upper body portions of the front and back body portions. The method also comprises attaching a neck binding to a periphery of the upper body portions of the front and back body portions, the neck binding having a visual indicator to identify a barrier protection level provided by and/or associated with the disposable surgical gown for protecting against penetration of body fluids and infectious materials, and attaching at least one tie to the main body of the surgical gown.

According to alternative embodiment UU, a method of using a surgical kit comprises the steps of identifying a desired barrier protection level and providing the surgical kit comprising a disposable surgical gown meeting the desired barrier protection level. The disposable surgical gown has a neck binding having a visual indicator to identify the barrier protection level provided by and/or associated with the surgical gown for protecting against penetration of body fluids and infectious materials. The method further comprising donning the surgical gown with the desired barrier protection level.

According to alternative embodiment VV, a disposable surgical gown includes a main body including a front body portion and a back body portion. The front body portion and the back body portion have respective upper body portions. The disposable surgical gown also includes sleeves attached to the upper body portions of the front and back body portions and a neck binding attached to a periphery of the upper body portions of the front and back body portions. At least a portion of the neck binding includes color-coding for identifying a barrier protection level provided by and/or associated with the disposable surgical gown for protecting against fluid contact.

According to alternative embodiment WW, a method of making a disposable surgical gown includes the steps of fabricating a main body of the disposable surgical gown. The main body has a front body portion, a back body portion and sleeves attached to respective upper body portions of the front and back body portions. The method also includes attaching a neck binding to a periphery of the upper body portions of the front and back body portions. The neck binding is color-coded to identify a barrier protection level provided by and/or associated with the disposable surgical gown for protecting against fluid contact. The method further includes attaching at least one tie to the main body of the surgical gown.

According to alternative embodiment XX, a method of distinguishing a disposable surgical gown includes providing a disposable surgical gown including a main body. The main body has a front body portion, a back body portion and sleeves attached to respective upper body portions of the front and back body portions. The main body includes a neck binding attached to a periphery of the upper body portions of the front and back body portions. The method also includes providing at least one indicia on the neck binding. The at least one indicia has a color thereon corresponding with a barrier protection level provided by and/or associated with the disposable surgical gown. The method further includes comparing the color of the at least one indicia to a color code, wherein the color code has a color corresponding with a barrier protection level provided by and/or associated with the disposable surgical gown.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the invention, which is set forth in the following claims.

What is claimed is:

1. A disposable surgical gown comprising:

a main body including a front body portion and a back body portion and sleeves attached to the front and back body portions, the front body portion and the back body portion including respective upper body portions; and a neck binding continuously attached to a periphery of the upper body portions of the front body portion and the back body portion, the neck binding having color-coding for identifying a barrier protection level associated with the disposable surgical gown, the color-coding being on an exterior surface of the neck binding and visible from front, side, and back views of the disposable surgical gown, the color-coding providing ease of identification of the barrier protection level from multiple views of the disposable surgical gown.

2. The disposable surgical gown of claim 1 wherein the color-coding relates to a barrier protection level designated by the Association for the Advancement of Medical Instrumentation standard AAMI PB70:2003.

3. The disposable surgical gown of claim 1 wherein the color-coding identifies barrier protection level 1 of AAMI PB70:2003.

4. The disposable surgical gown of claim 1 wherein the color-coding identifies barrier protection level 2 of AAMI PB70:2003.

5. The disposable surgical gown of claim 1 wherein the color-coding identifies barrier protection level 3 of AAMI PB70:2003.

6. The disposable surgical gown of claim 1 wherein the color-coding identifies barrier protection level 4 of AAMI PB70:2003.

7. The disposable surgical gown of claim 1 further comprising at least one tie for securing the main body of the disposable surgical gown and a pass card that is releasably attached to the at least one tie, at least a portion of the pass card having the same color-coding as the color-coding of the neck binding.

8. The disposable surgical gown of claim 1 further comprising inner and outer ties for fastening the main body of the disposable surgical gown around the body of a user and a pass card that is releasably attached to at least one of the inner and outer ties, at least a portion of the pass card having the same color-coding as the color-coding of the neck binding.

9. A disposable surgical gown comprising:

a main body including a front body portion and a back body portion, the front body portion and the back body portion including respective upper body portions;

a pair of sleeves attached to the upper body portions at a region where the front body portion and the back body portion meet; and a neck binding continuously attached to a periphery of the upper body portions of the front body portion and the back body portion, the neck binding having a visual indicator for identifying a barrier protection level associated with the disposable surgical gown for protecting against penetration of body fluids and infectious materials, the visual indicator being on an exterior surface of the neck binding and visible from front, side, and back views of the disposable surgical gown, the visual indicator providing ease of identification of the barrier protection level from multiple views of the disposable surgical gown.

10. The disposable surgical gown of claim 9 wherein the visual indicator identifies a barrier protection level designated by the Association for the Advancement of Medical Instrumentation standard, AAMI PB70:2003.

11. A surgical kit comprising:

a disposable surgical gown for protecting against penetration of bodily fluids and infectious materials, the disposable surgical gown having a front body portion, a back body portion and sleeves connected to the front and back body portions, the front body portion and the back body portion including respective upper body portions, and a neck binding continuously attached to a periphery of the upper body portions of the front body portion and the back body portion, the neck binding including color-coding to identify a barrier protection level of the disposable surgical gown, the color-coding of the neck binding being on an exterior surface of the neck binding and visible from different views of the disposable surgical gown;

a pass card releasably attached to the disposable surgical gown, at least a portion of the pass card including color-coding to identify the barrier protection level of the disposable surgical gown; and a package for holding the disposable surgical gown and the pass card.

12. The surgical kit of claim 11 wherein the color-coding identifies a barrier protection level designated by the Association for the Advancement of Medical Instrumentation standard, AAMI PB70:2003.

13. The surgical kit of claim 11 wherein the pass card is releasably attached to at least one tie on the disposable surgical gown.

14. The surgical kit of claim 11 further comprising an insert which describes the contents of the surgical kit, at least a portion of the insert including color-coding to identify the barrier protection level of the disposable surgical gown.

15. The surgical kit of claim 11 further comprising a surgical wrap for protecting the sterility of the disposable surgical gown, wherein the surgical wrap includes color-coding to identify the barrier protection level of the disposable surgical gown.

16. The surgical kit of claim 11 further comprising a hand towel, wherein the hand towel includes color-coding to identify the barrier protection level of the disposable surgical gown.

17. A surgical kit comprising:

a disposable surgical gown for protecting against penetration of bodily fluids and infectious materials, the disposable surgical gown having a front body portion, a back body portion and sleeves connected to the front and back body portions, the front body portion and the back body portion including respective upper body portions, wherein the disposable surgical gown has a neck binding continuously attached to a periphery of the upper body portions of the front body portion and the back body portion, the neck binding having a visual indicator to identify a barrier protection level of the disposable surgical gown, the visual indicator of the neck binding being on an exterior surface of the neck binding and visible from front, side, and back views of the disposable gown, the visual indicator of the neck binding providing ease of identification of the barrier protection level from multiple views of the disposable surgical gown;

a pass card releasably attached to the disposable surgical gown, at least a portion of the pass card having a visual indicator to identify the barrier protection level of the disposable surgical gown; and a package for holding the disposable surgical gown and pass card.

18. The surgical kit of claim 17 wherein the visual indicator of the neck binding and the visual indicator of the pass card identify a barrier protection level designated by the Association for the Advancement of Medical Instrumentation standard, AAMI PB70:2003.

19. A method of using a surgical kit comprising the steps of:

identifying a desired barrier protection level;

providing a surgical kit comprising a disposable surgical gown meeting the desired barrier protection level, the disposable surgical gown including a neck binding continuously attached to a periphery of an upper body portion, the neck binding having color-coding for identifying the desired barrier protection level, the color-coding being on an exterior surface of the neck binding such that the color-coding is visible from front, side, and back views of the disposable surgical gown; and;

donning the disposable surgical gown with the desired barrier protection level, the desired barrier protection level being identifiable from multiple views of the disposable surgical gown based on the color-coding.

20. The method of claim 19 wherein the barrier protection level identifies a barrier protection level designated by the Association for the Advancement of Medical Instrumentation standard, AAMI PB70:2003.

21. A method of using a surgical kit comprising the steps of:

identifying a desired barrier protection level;

providing a surgical kit comprising a disposable surgical gown meeting the desired barrier protection level, the disposable surgical gown including a neck binding continuously attached to a periphery of an upper body portion, the neck binding having a visual indicator for identifying the desired barrier protection level, the visual indicator being on an exterior surface of the neck binding such that the visual indicator is visible from front, side, and back views of the disposable surgical gown; and donning the disposable surgical gown with the desired barrier protection level, the desired barrier protection level being identifiable from multiple views of the disposable surgical gown based on the visual indicator.

22. The method of claim 21 wherein the barrier protection level identifies a barrier protection level designated by the Association for the Advancement of Medical Instrumentation standard AAMI PB70:2003.

* * * * *